US006651368B1

(12) United States Patent
Blanks, I.

(10) Patent No.: US 6,651,368 B1
(45) Date of Patent: Nov. 25, 2003

(54) CONTAINERS WITH AN INNER SUPPORT SYSTEM

(76) Inventor: Stevenson T. Blanks, I., 1142 W. 26th St., Erie, PA (US) 16508

( * ) Notice: Subject to any disclaimer, the term of this patent is extended or adjusted under 35 U.S.C. 154(b) by 94 days.

(21) Appl. No.: 09/829,120

(22) Filed: Apr. 9, 2001

(51) Int. Cl.[7] ..... G09F 3/20; A47G 1/06

(52) U.S. Cl. ..... 40/649; 40/765

(58) Field of Search ..... 40/1.6, 639, 642.02, 40/649, 650, 654.01, 658, 661.04, 661.05, 661.06, 661.07, 709, 710, 722, 738, 752, 765, 775, 777, 791

(56) References Cited

U.S. PATENT DOCUMENTS 908,069 A * 12/1908 Bretz, Jr. ..... 40/1.6
3,415,407 A 12/1968 Alden et al.
3,496,665 A 2/1970 Goldman
3,961,431 A 6/1976 Kalenian
4,016,664 A 4/1977 Kaufmann
5,075,991 A 12/1991 Wenkman et al.
5,584,133 A * 12/1996 Motooka et al. ..... 40/642.02
5,771,619 A * 6/1998 Wells ..... 40/643
6,154,992 A 12/2000 Razgo Lee
6,178,680 B1 * 1/2001 Sloot ..... 40/668

* cited by examiner

*Primary Examiner*—S. Joseph Morano
*Assistant Examiner*—Andrew Wright
(74) *Attorney, Agent, or Firm*—Jones, Tullar & Cooper, P.C.; Daniel A. Sullivan, Jr.

(57) ABSTRACT

A sheet material container, which, when observed, gives a uniform geometric appearance. The appearance of the container of the present invention is accomplished through the use of an oval-shaped base section and an oval brim spaced by a lateral wall. These cooperate to provide lateral, opposed, crescent-shaped pockets which hold an oval-shaped sheet material.

17 Claims, 19 Drawing Sheets

CONTAINERS WITH AN INNER SUPPORT SYSTEM

TECHNICAL FIELD

This invention relates to containers with an inner support system for the purpose of containing and displaying identifications, advertisements, indicia, mottos, pictures and the like.

BACKGROUND ART

U.S. Pat. Nos. 3,415,407, 3,496,665, 3,961,431, 4,016,664 and 5,075,991 all show front-entry, sheet material holders where it is evident from the appearance of the holders that rectangular sheet material is being held by lip-like protrusions which interrupt a perfectly rectangular framing of the sheet material.

SUMMARY OF THE INVENTION

This invention proposes a container which can be applied to various items for containing and exhibiting images, such as identifications, advertisements, indicia, mottos, pictorial matters and the like. The container is capable of being separately or integrally applied as a single molded body, to serve or containing or exhibiting identification, advertisement, indicia, mottos, pictorial matters and the like. The container is suitable for containing and exhibiting quick slidably release displayable matters, that are interchangeable and/or reversible. Methods are provided for attaching the container onto various items quickly, easily and simply.

An aim of this invention is to provide an easily operable structure for exhibiting identification, advertisement, indica, trademark, mottos, pictorial matters and the like on selected items.

Another aim of the invention is to show various sizes and shapes of items into which the inner support structure can be formed.

Another aim of the invention is to provide a panel on which is imprinted displayable matters such as identification, labels, advertisement, indica, mottos, pictures and the like that are removable, changeable and reversible.

Another aim of the invention is to provide fastening means for the purpose of connecting the container carrying identification, advertisement, indica, trademark, mottos, pictorial matters and the like onto various items.

Yet further, another aim of the invention is to show various items onto which the inner support structure of the invention can be applied to.

The invention possesses other aims and advantages particularly as concerns the characteristics and emphases thereof which will become evident as the disclosure continues.

Characteristic of the present invention is the provision of a sheet material container, which, when observed, gives a uniform geometric appearance, in contrast to the instances mentioned above in the section BACKGROUND ART. The appearance of the container of the present invention is accomplished through the use of an oval-shaped base section and an oval brim spaced by a lateral wall. These cooperate to provide lateral, opposed, crescent-shaped pockets which hold an oval-shaped sheet material.

DESCRIPTION OF THE PREFERRED EMBODIMENTS

Turning now in detail to the drawings, wherein like numerals denote like components, a sheet-material display container of the invention is presented in several embodiments.

Figure 1:
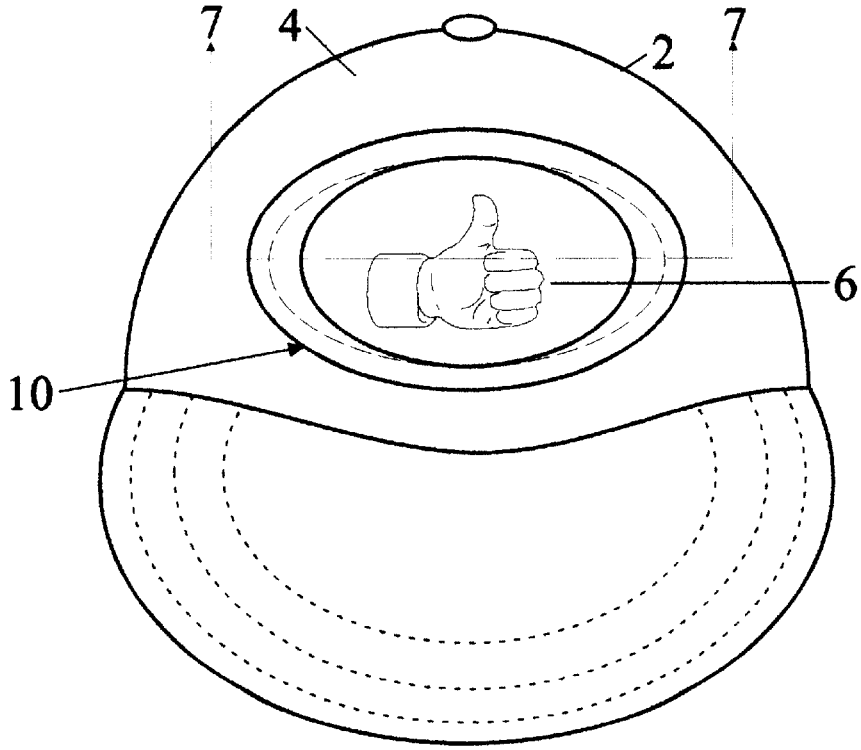
FIGS. 1 and 2 are front views of a cap bearing a container.
Figure 2:
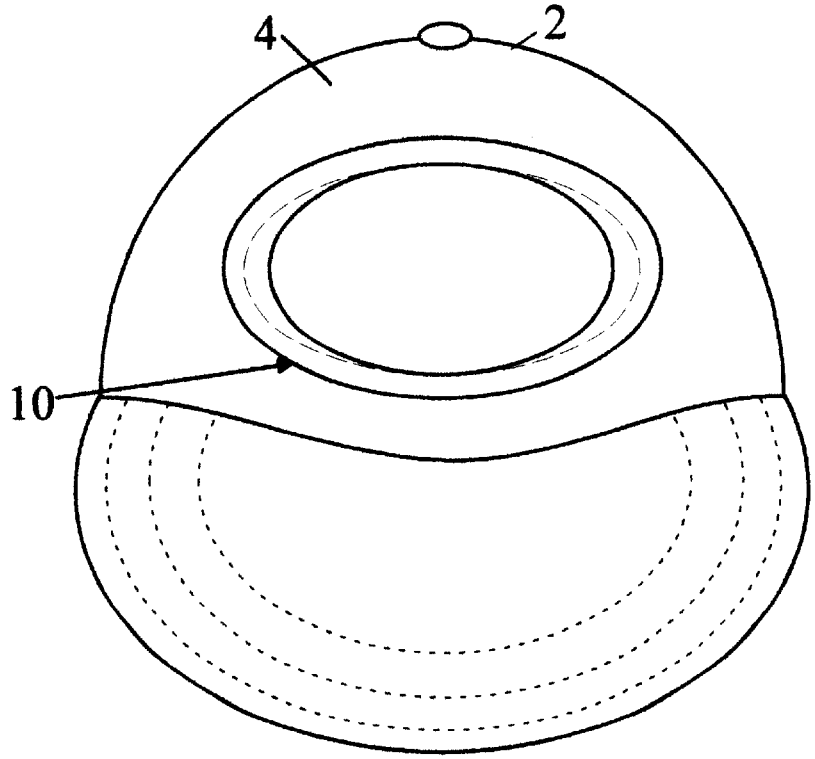

In FIGS. 1 and 2, a container 10 is mounted on the front exterior section 4 of a cap 2. Container 10 may, of course, be placed onto any desired section of the cap. In FIG. 1, a sheet material 6 bearing a "thumbs-up" image has been inserted into container 10, while in FIG. 2 the container is empty.

Figure 3:
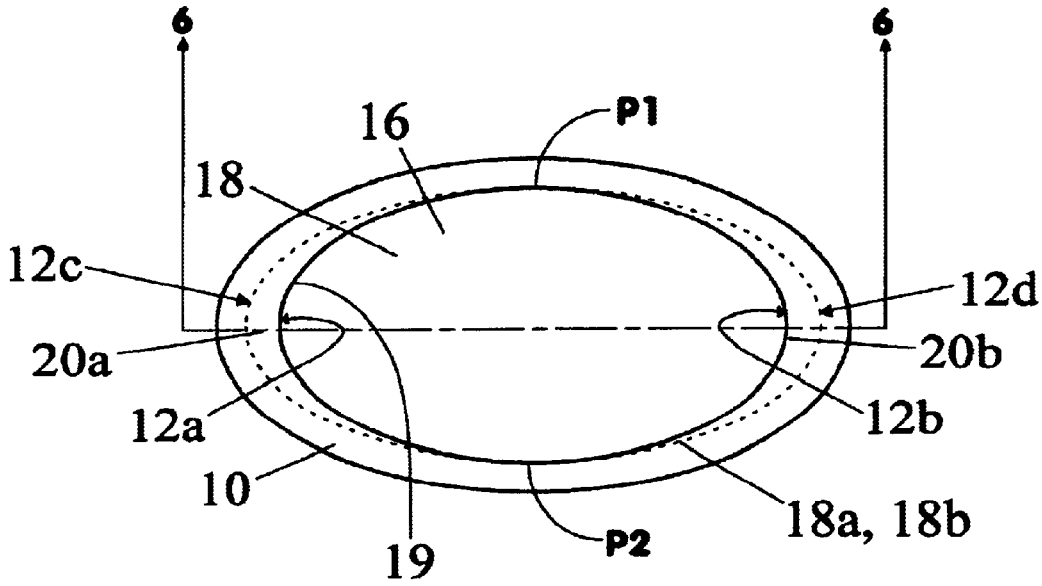
FIGS. 3 to 5 are, respectively, front, back and bottom views of a container of FIG. 2.
Figure 4:
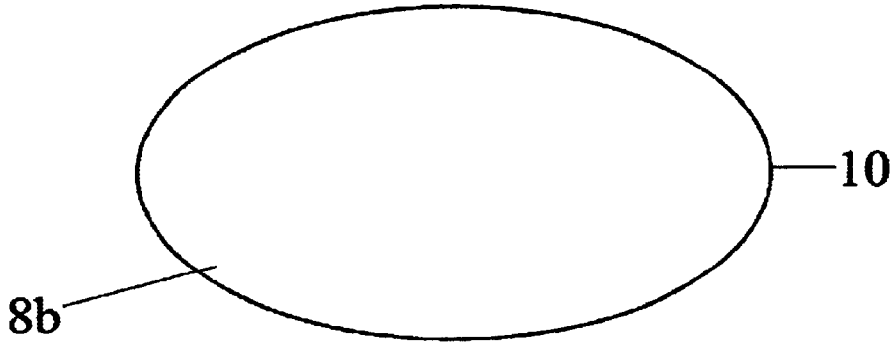

FIGS. 3 and 4 illustrate the front side 8*a* and the back side 8*b*, respectively, of the container 10. As shown in FIG. 3, container 10 has an inner support pocket section 16.

In FIG. 3, section 16 comprises an oval-shaped, base section 18 and an oval brim 19. As shown in cross section in FIG. 6, brim 19 is spaced from base section 18 by lateral wall 18*a*. Wall 18*a* rises from the oval perimeter 18*b* of base section 18. Wall 18*a* and perimeter 18*b* are both indicated in FIG. 3 by the dashed line, since both are hidden there, beneath brim 19.

Base section 18, wall 18*a*, and brim 19 cooperate to provide lateral, opposed, crescent-shaped pockets 20*a,b*, and openings 12*a,b* into the tops of pockets 20*a,b*, respectively, for receiving and holding sheet material 6 (FIGS. 1 and 7) which is to be exhibited within the container. As the sides (i.e. wall 18*a*) of the pockets approach one another they merge with brim 19 at points P1 and P2 midway between the two pockets. Wall 18*a* blocks insertion or extraction of sheet material through the bottoms 12*c,d* of the pockets.

In the illustrated embodiment, the ovals seen in FIG. 3 are ellipses. The ellipse of the perimeter 18*b* of base section 18 and wall 18*a* shares a common minor axis (between points P1 and P2) with the ellipse of the inner edge of brim 19. However, the major axes, while both lying on the cutting plane 6—6, are of different lengths, that of base section 18 and wall 18*a* being longer than that of brim 19. This difference in the lengths of the major axes leads to the formation of the crescent-shaped pockets 20*a*, 20*b*. For ellipse terminology, see, for example, FIG. 4.47 on page 110 of Engineering Graphics, 4th Edition, by Frederick E. Giesecke et al., Macmillan Publishing Co., New York, 1987.

One important advantage of the common minor axis is that the tips of the opposing crescent-shaped pockets just touch one another, which means that an oval shaped sheet material in the pockets is held on almost all of its edge, except at the points P1 and P2. As a second important advantage of the common minor axis, sheet material only has to be bent with its surface elements parallel to that axis during the below-described process of inserting the sheet material into the pockets. In contrast, if the minor axis of the brim would be less than that of the base section, a difficult bending of the sheet material about two axes would be required for insertion.

Figure 5:
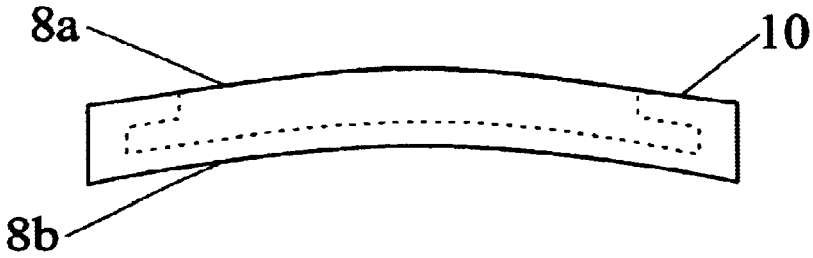

FIG. 5 shows the container 10 having an adequate measure of arch to match the arch of a surface onto which it is to be mounted, for instance the arch of the front exterior section 4 of cap 2. A container 10 with a flat surface could be used when the mounting surface is flat.

Figure 6:
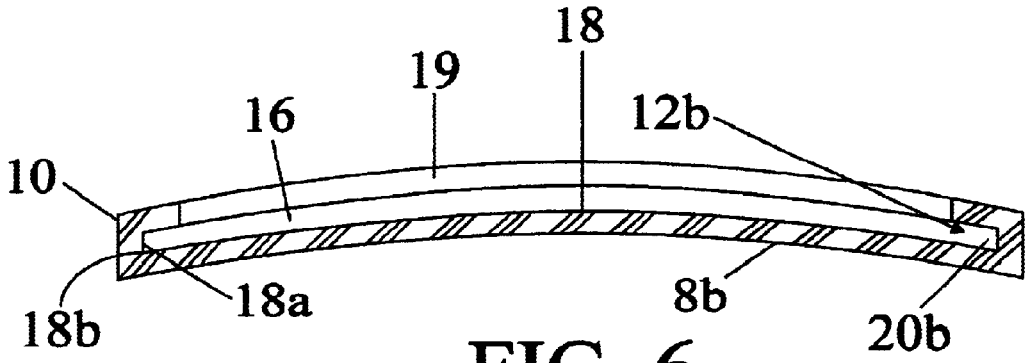
FIG. 6 is a cross sectional view taken on cutting plane 6—6 of FIG. 3.

In FIG. 6, in cross section of the container 10, pockets 20*a,b* have openings 12*a,b*. The pockets 20 are sized to comfortably slidably receive and to tightly detain a sheet material 6 when it enters therein.

Figure 7:
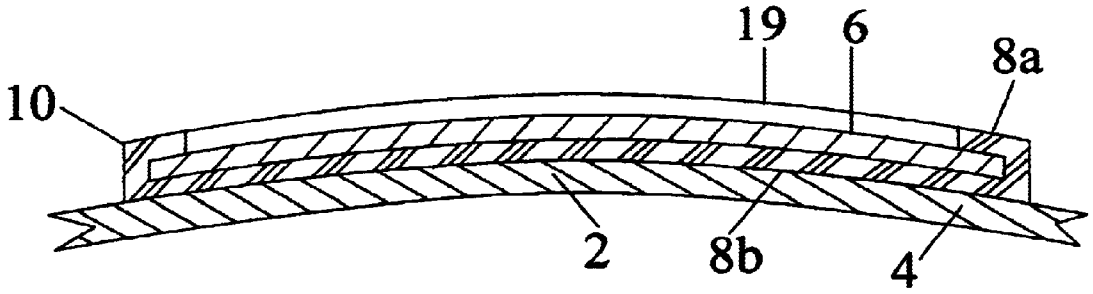
FIG. 7 is a cross sectional view taken on cutting plane 7—7 of FIG. 1.

In FIGS. 1 and 2, container 10 is permanently fastened onto front exterior section 4 of cap 2 by a suitable means, such as a water resistant glue. The water resistant glue (not shown) is applied to the back side surface 8*b* of the container 10. The container is then pressed against cap 2, where the glue solidifies to permanently fasten the container onto the front exterior section 4, as seen in FIG. 7.

It is important to note that the container 10 can be permanently fastened onto the cap 2 at the time of manufacturing, or optionally, the container can be permanently fastened onto the cap by a consumer, who already may have one of the containers or may purchase one at a department store. The manufacturer can even provide a kit that would include a container 10, a cap 2, and permanent fastening means, along with instructions for how the kit is to be used.

The sheet material 6, also of an oval shape, is sized to be resiliently accepted into the pockets 20 of container 10 and to be detained therein. The oval outline of sheet material 6 may, for example, be just slightly smaller than that of base section 18 and wall 18*a*, so that the sheet material can fit in the inner support pocket section 16 and yet be constrained as to orientation by wall 18*a*. The sheet material 6 may carry an identification, advertisement, indicia, mottos, pictures and/or the like.

Sheet material 6 must be flexible. For instance, it can be a thin sheet of plastic material. Alternatively, a heavy weight paper can be involved, in which case after an image is printed on the heavy weight, paper, it then can be heat or cold sealed between two sheets of laminating film, so that the resulting laminated assembly has resilient characteristics mostly contributed by the film and the image and paper are completely protected by the film.

Figure 8:
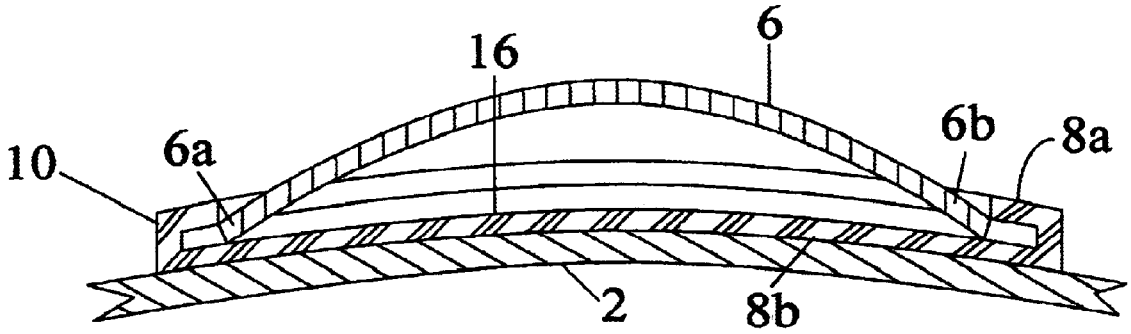
FIG. 8 is a view as in FIG. 7, illustrating a method of the invention.

FIG. 8 shows how to insert and display the sheet material 6 within container 10 and FIG. 7 how the sheet material, once inserted, is held within the container. The sheet material is inserted on the front side of the container. First the sheet material is clasped and held with the fingers, so that it bends with a tighter arc then the container. The ends 6*a* and 6*b* of the sheet material approach one another. The ends of sheet material 6 are then placed in pocket section 16 directed toward openings 12*a,b* on the front side 8*a* of the container 10. The left and right ends of the sheet material 6 should now be touching the container's oval shaped base section 18, with the left and rights ends aligned into the openings 12. Next the sheet material 6 is slowly unclasped, whereupon it slidably enters into openings 12, so that it comes to rest in pockets 20*a,b*, as shown in FIG. 7. After the ends rest in pockets 20*a,b*, the sheet material 6 also lies flat against the oval base section 18 for the purpose of exhibiting the sheet material and any images which it may bear. The sheet material 6 is held and secured within the container by its resilience, so that the sheet material can not accidentally fall out of container 10.

To exchange one sheet material 6 for another, all one has to do is to clasp the top surface of the sheet material 6 near left and right ends with the fingers and pull the fingers inwardly until the left end and right ends of the sheet material are released from within the pockets 20*a,b*. Next, install another desired sheet material 6 by following the installation procedure provided above.

It has been found that it is easier to release a smooth plastic sheet material 6 from the container 10, when the container has some arch, such as the arch shown in FIGS. 5–8 for conforming to that of the front exterior section 4 of cap 2. In contrast, if the container is absolutely flat, there may not be enough friction between one's fingers and a smooth plastic sheet material to get the ends of the sheet material to release from the pockets. In such case, rubber thimbles placed on the fingers, for instance those thimbles sold as SWINGLINE Rubber Finger Tips, of ACCO USA, Wheeling, Ill., have been found to increase friction sufficiently to permit removal.

Although the invention has been illustrated on the basis of a cap, it is not intended to be limited to that item.

Container 10 may be made from any number of materials, such as plastics, rubber, metal or wood, by processes such as injection molding, casting, pressure/thermoforming, welding, soldering, bonding, or machining. It is recognized that container 10 may be molded or machined as one unit, or a top layer containing brim 19 may be made separately and, in a subsequent step, joined to the rest of the container.

Figure 9:
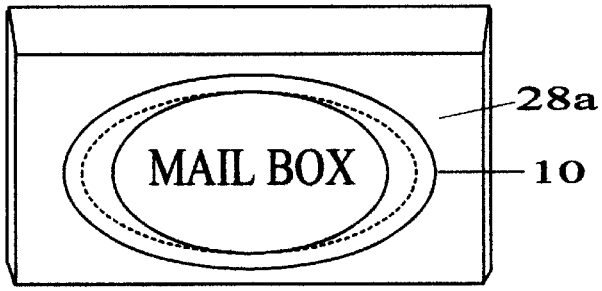
FIGS. 9–18 are front views of items bearing a container 10 of the invention.
Figure 10:
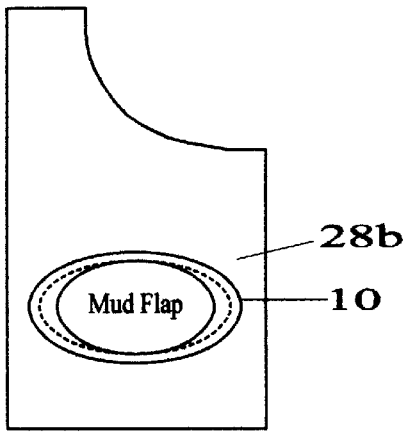
Figure 11:
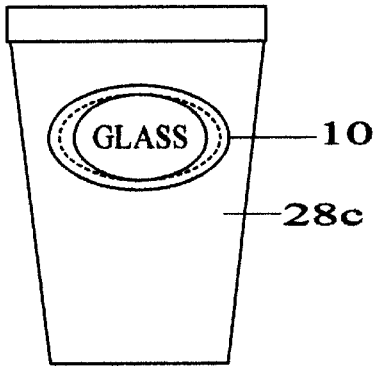
Figure 12:
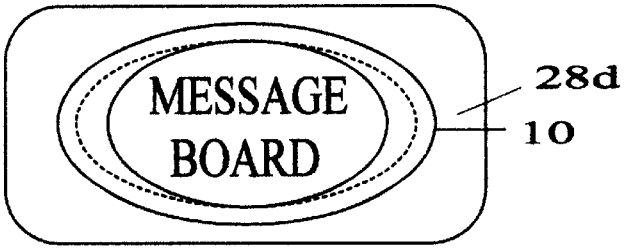
Figure 13:
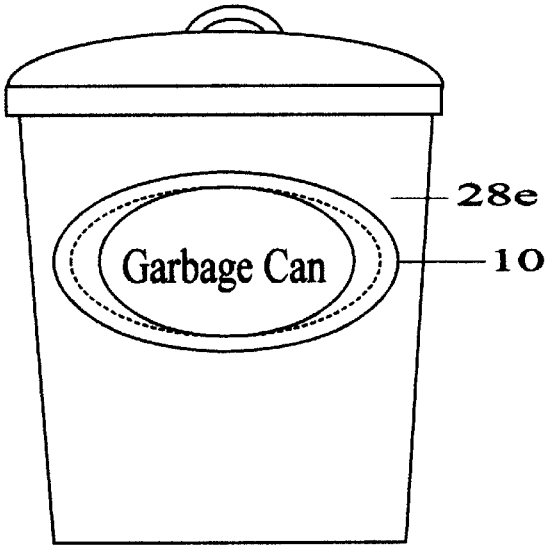
Figure 14:
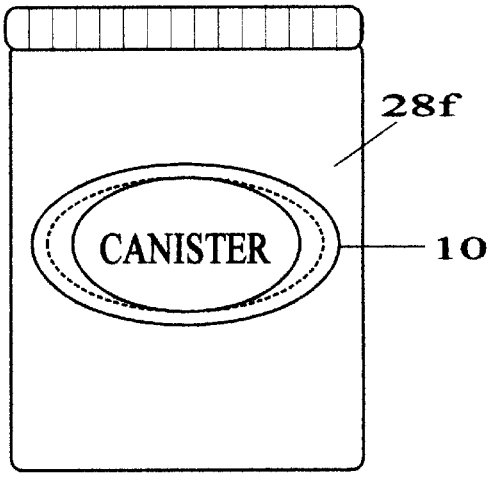
Figure 15:
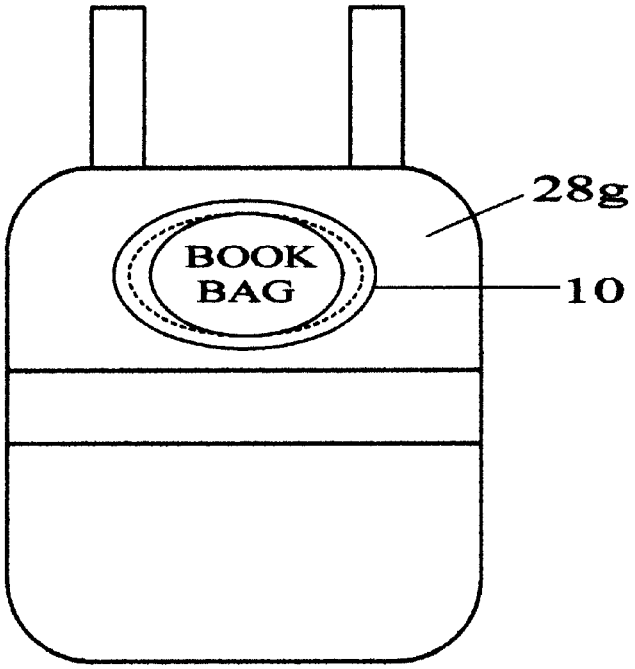
Figure 16:
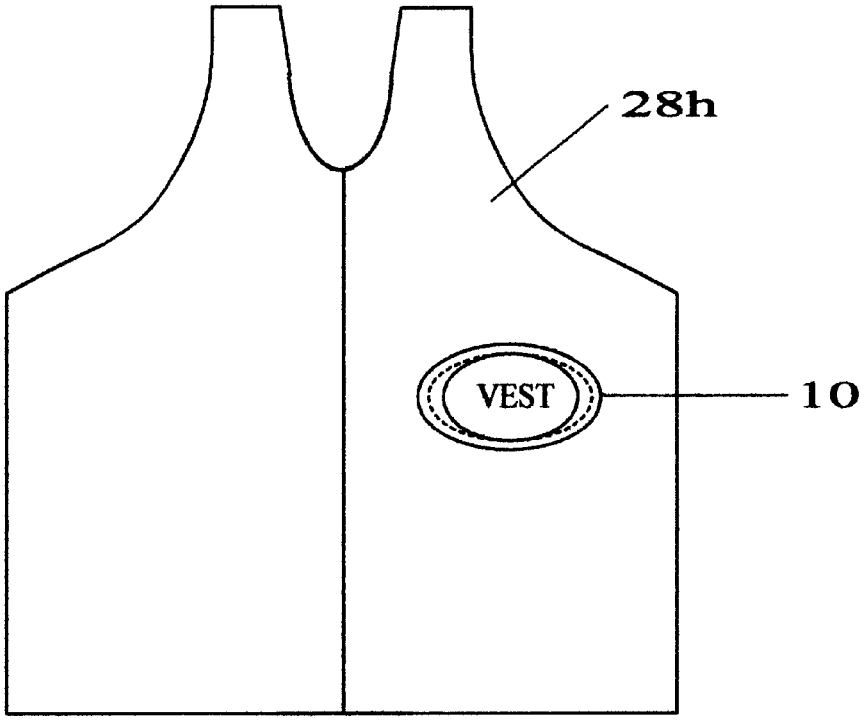
Figure 17:
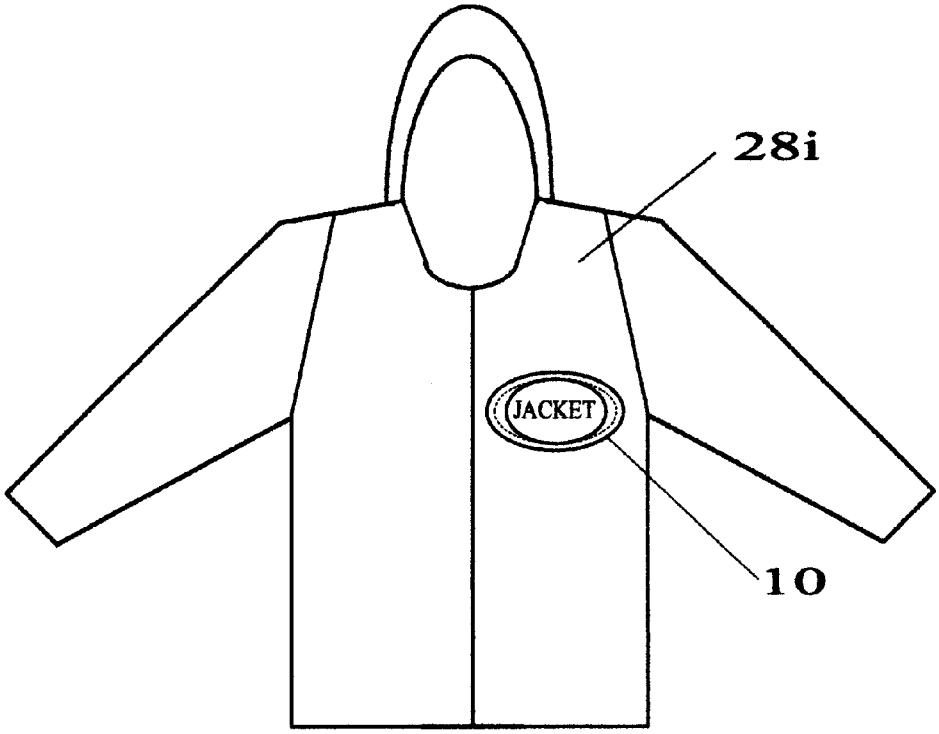
Figure 18:
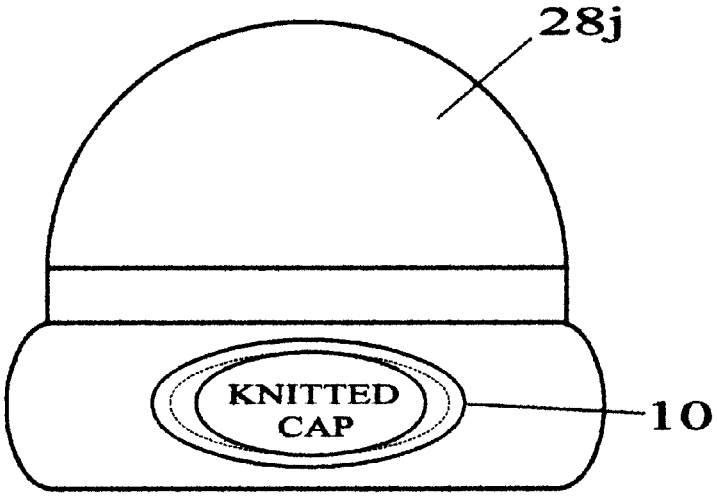

FIGS. 9 through 18 are illustrations of a container 10 of the invention, mounted on various items, namely on a mail box 28*a* in FIG. 9, a mud flap 28*b* in FIG. 10, a glass 28*c* FIG. 11, a message board 28*d* FIG. 12, a garbage can 28*e* in FIG. 13, a canister 28F in FIG. 14, a back pack or book bag 28*g* in FIG. 15, a vest 28*h* in FIG. 16, a jacket 28*i* in FIG. 17 and a knitted hat 28*j* in FIG. 18. In each of these examples, the container 10 may, as well, be molded integrally with the item, instead of being mounted separately.

Next is an illustration of an alternative means to fasten a container of the invention onto a cap. This means gives the container the ability to be removed from one cap and to be transferred onto another. This advantage is accomplished by outfitting the back side of the container with enter locking members, and by also employing a locking ring member that is outfitted with enter locking portals, into which the enter locking members are to enter for the purpose of temporarily fastening the container onto the cap.

Figure 19:
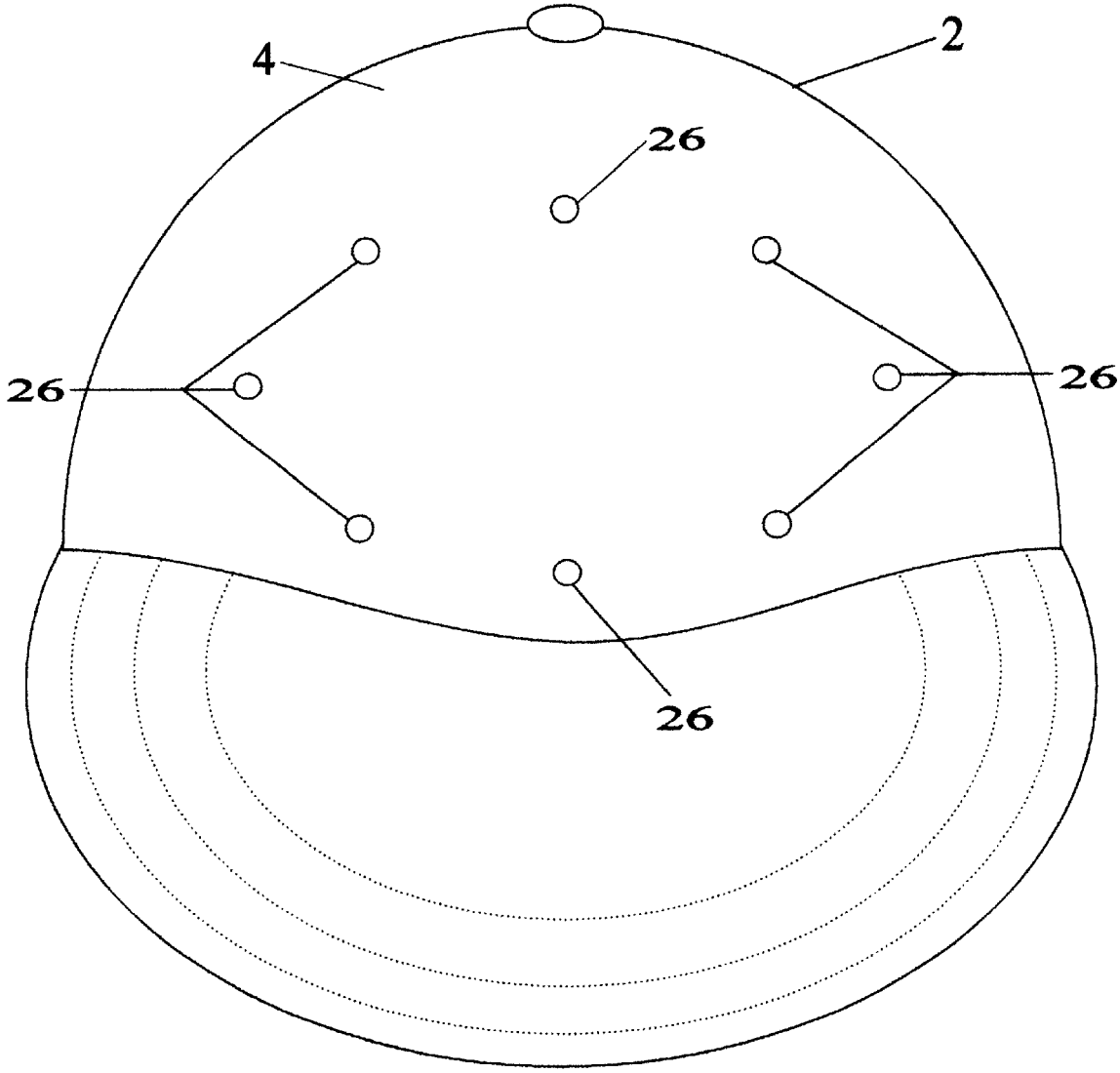
FIG. 19 is a front view of a cap.

To this end, cap 2 of FIG. 19 is shown to have eight small portals 26 spaced at a desired distance from one another on its front exterior section 4. The eight portals 26 act as a means for fixing the container 10 with respect to the cap 2 when eight enter locking members enter through the eight portals 26. The eight portals 26 are structured to fit tightly around each of the enter locking members so that there is no play between the container and cap.

The eight portals 26 can be made or formed on the cap 2 at the time of manufacturing or optionally eight portals 26 can be made or formed on the item 2 by the consumer. In this second case, the manufacturer can provide a kit which would include an oval shaped flat panel outfitted with eight portals which the consumer would use to mark the location of the eight portals 26 with a marker to mark out the said portals on the desired exterior section of the cap. After the said portals are marked out, the consumer would use a suitable hole puncher to punch out the marks to form the portals 26 in the cap 2. After the portals 26 are made or formed on the cap 2, the consumer is then able to fasten a container of the invention on the cap 2 and display a sheet material. The kit could also include a container of the invention outfitted with enter locking members and an enter locking ring with enter locking portals, and a cap 2, in addition to the oval shaped panel, a marker and a suitable hole puncher, along with instructions for how the kit is to be used.

Figure 19A:
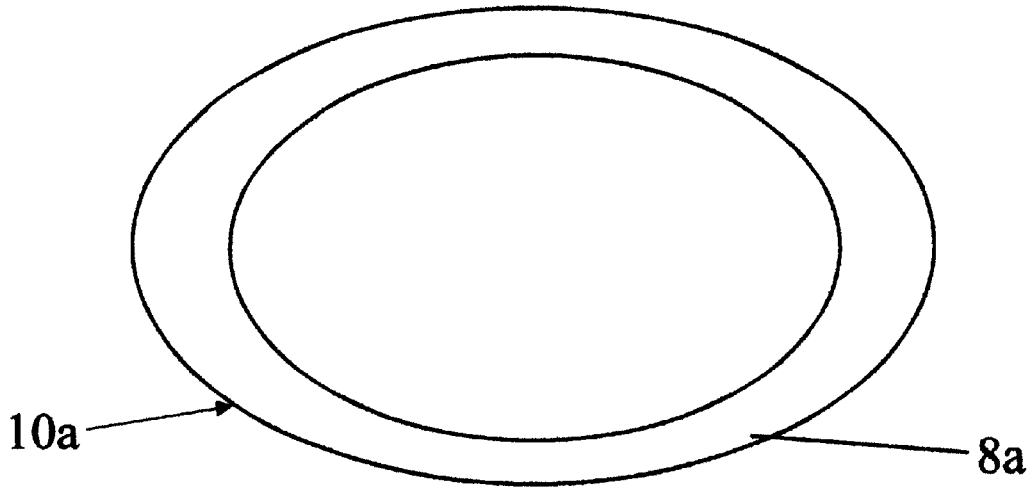
FIGS. 19A and 19B are, respectively, front and back views of a container.
Figure 19B:
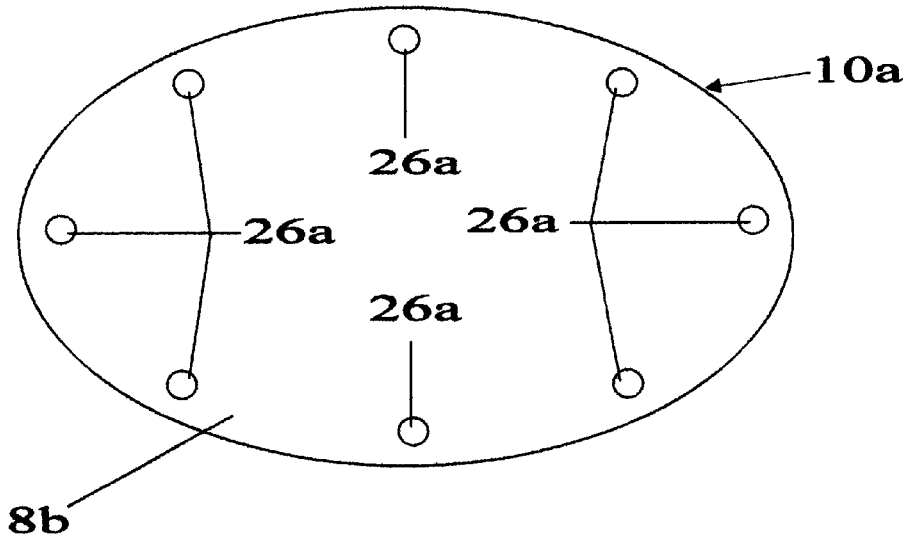

In FIGS. 19A and 19B, the front side 8*a* and back side 8*b* of a container 10*a* are shown. The back side 8*b* of container 10*a* is outfitted with eight enter locking members 26*a*, spaced at a desired distance around its edge. Container 10*a* differs from container 10 in the provision of the locking members 26*a*. The placement of the members 26*a* matches that of portals 26 in FIG. 19. The eight enter locking members 26*a* are used to aid in securing the container 10*a* onto the cap 2 by advancing through the spaced, separated portals 26 located on the front exterior section 4 of the cap 2, to mate with eight enter locking portals on a locking ring member to be discussed below.

Figure 19C:
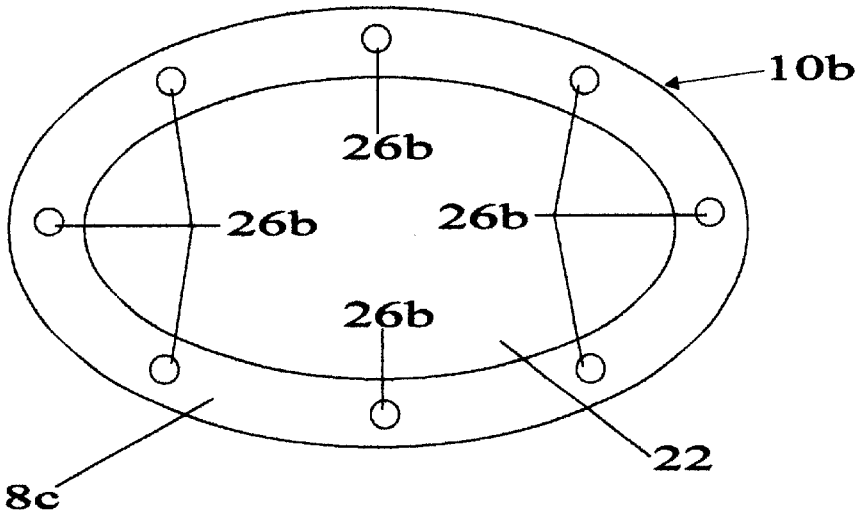
FIGS. 19C and 19D are, respectively, front and back views of a locking ring member.
Figure 19D:
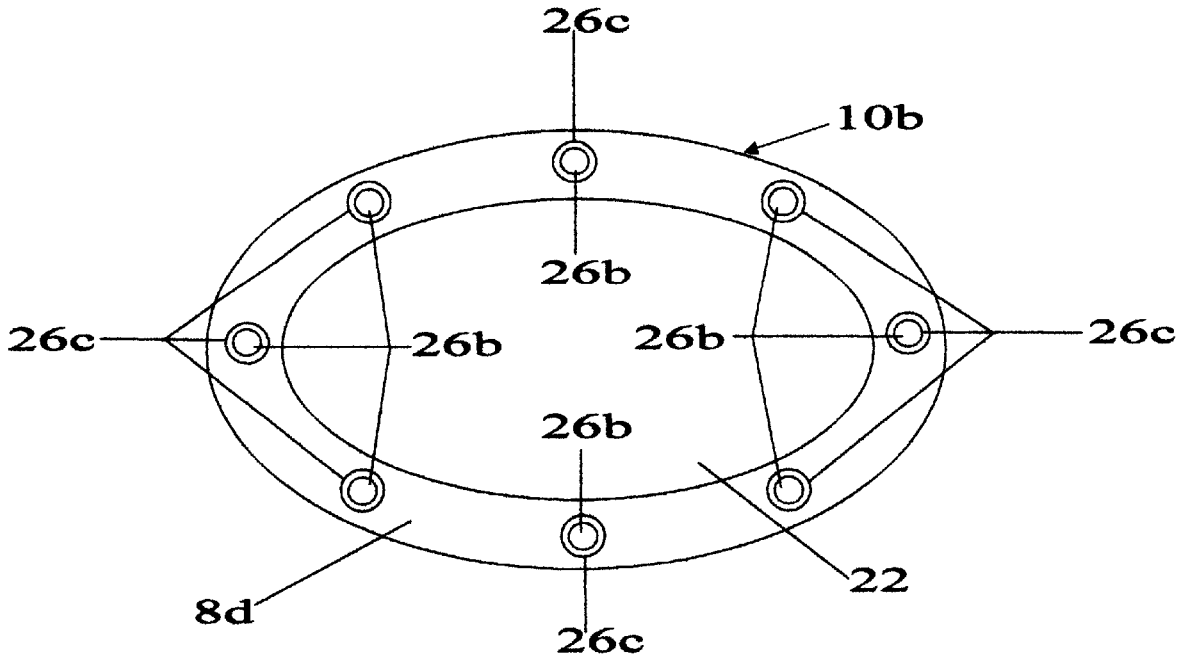

FIGS. 19C and 19D show an oval shaped locking ring member 10*b*, having a central opening 22. Its first side 8*c* has eight small enter locking portals 26*b* spaced at the desired matching distance and intermediate its inside and outside edges. The second side 8*d* of member 10*b* has eight annular recesses 26*c* around the eight portals 26*b* as shown.

Figure 19E:
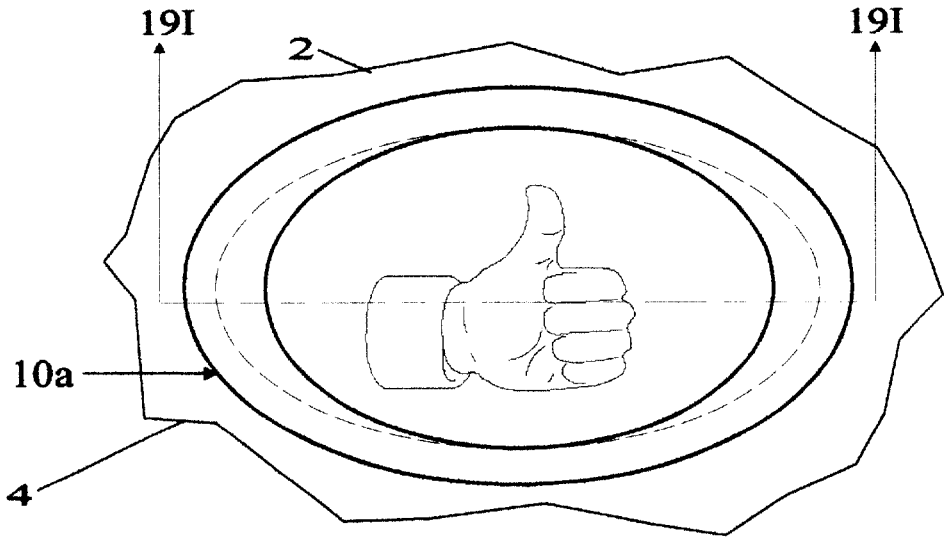
FIGS. 19E and 19F are, respectively, elevational outside and inside views of cap.
Figure 19F:
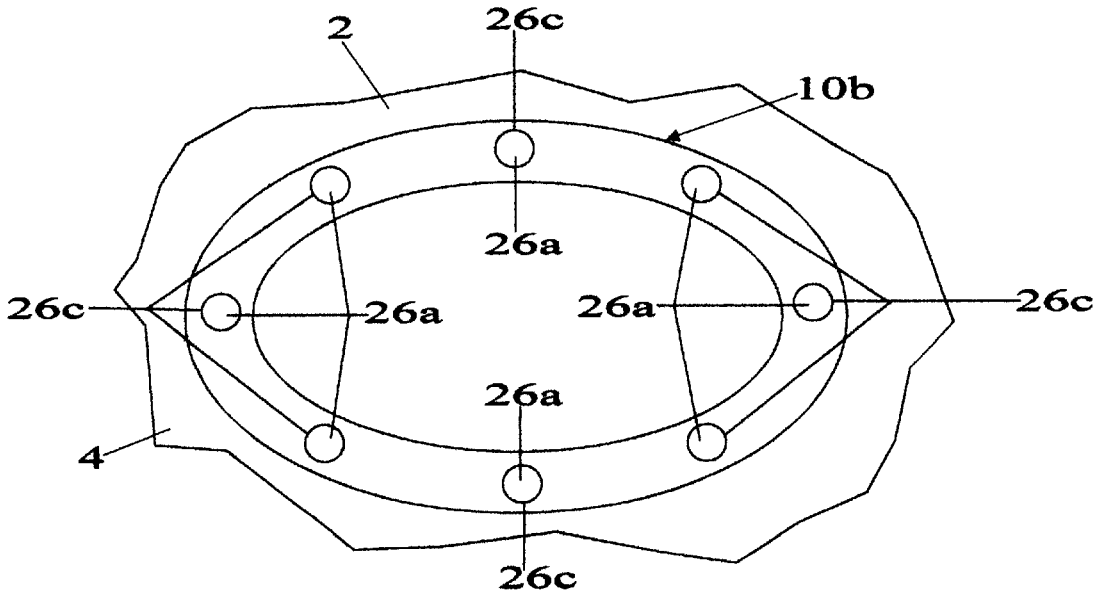

FIGS. 19E and 19F are views, respectively, outside and inside of a cap 2, with container 10*a* and locking ring member 10*b* assembled onto the cap. FIG. 19F shows the eight enter locking members 26*a* seated in the eight annular recesses 26*c*.

Figure 19G:
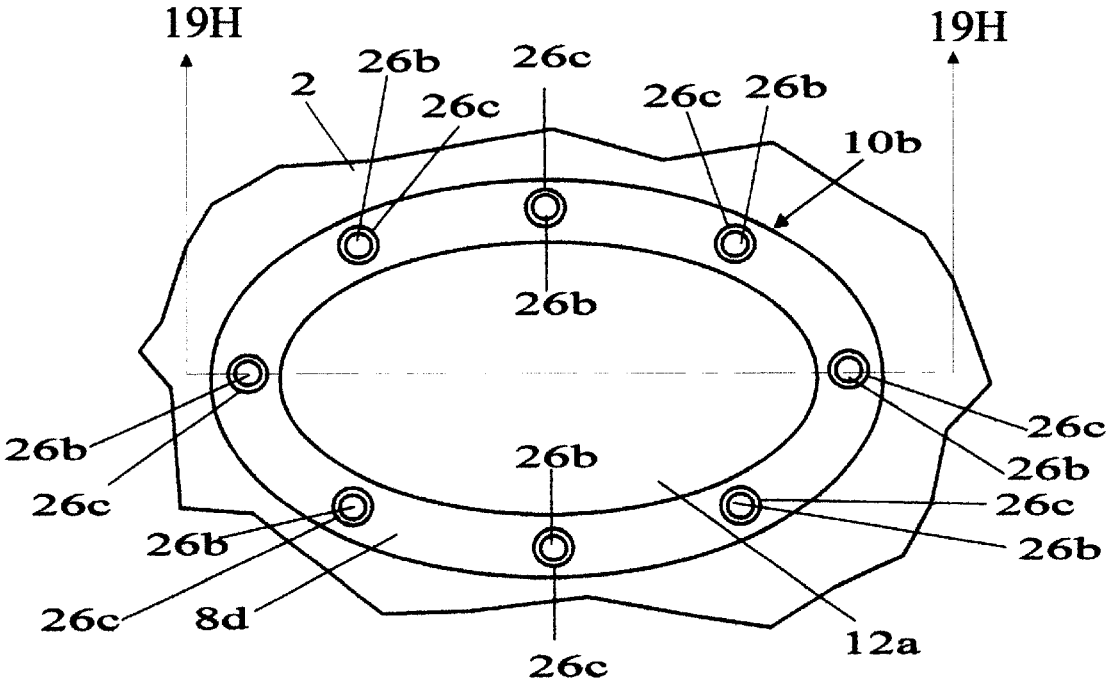
FIG. 19G is a view as in FIG. 19F.
Figure 19H:
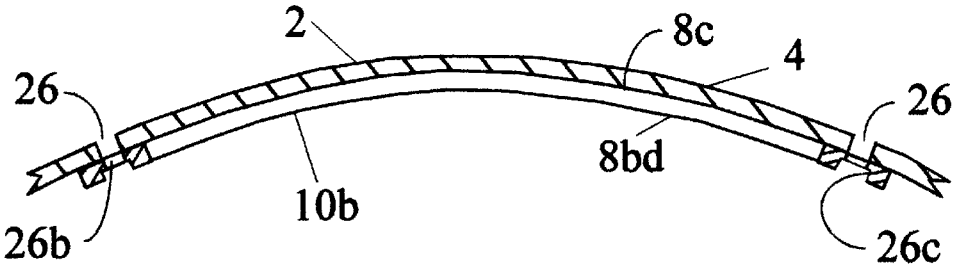
FIG. 19H is a view taken on the cutting plane 19H—19H of FIG. 19G.
Figure 19I:
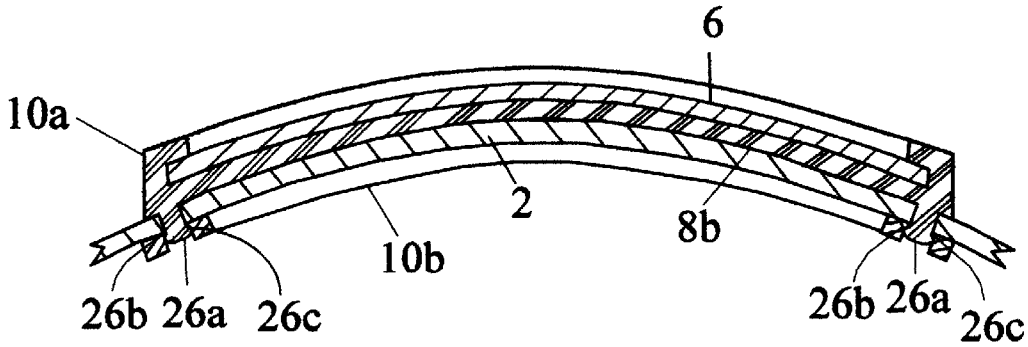
FIG. 19I is a view taken on the cutting plane 19I—19I of FIG. 19E.

FIGS. 19G through 19I illustrate how container 10*a* and the locking ring member 10*b* are fastened onto cap 2, so that a sheet material 6 can be displayed thereon.

First, as shown in FIGS. 19G and l9H, the locking ring member 10*b* is positioned on the inside of cap 2, with its first side 8*c* against the cap and its eight enter locking portals 26*b* aligned with the corresponding eight portals 26 of the cap.

Next, to achieve the configuration shown in FIG. 19I, the eight enter locking members 26*a* located on the back side 8*b* of the container 10*a* are aligned with, and pushed through, the eight portals 26 located on the cap 2 to enter the eight portals 26*b* on the locking ring member 10*b*, to secure the container 10*a* carrying a sheet material 6 onto the cap 2. The container 10*a* and locking ring member 10*b* are then slightly squeezed to force the enter locking members 26*a* through the portals 26*b*, so that they can catch in the recesses 26*c*. This assembled state is shown in FIG. 19I.

In assembly, each of the enter locking members 26*a* on the container 10 is engaged in its enter locking portal 26*b*. The head portions of the enter locking members 26*a* rest within each of the recesses 26*c* located on the second side 8*d* of the locking ring member 10*a*.

The head portions of the enter locking members 26*a* are designed and constructed to be somewhat larger than the portals 26*b* located on the ring locking member 10*b*. They can nevertheless be pushed through portals 26*b*, due to resilience in the plastics material of construction. This interference fit means that the container 10*a* and the locking ring member 10*b* will not become disconnected, which could otherwise result in the loss of the container 10*a* with the sheet material 6 and the locking ring member 10*b*.

Since the enter locking members 26*a* on the back side of the container 10*a* are a little larger in size then the mating portals 26*b* on the locking ring member 10*b*, members 26*a* have to be frictionally pushed through the enter locking portals 26*b*, in order to enter the enter locking portal 26*b* to join the container 10*a* and the ring member 10*b* together, thereby securing them onto the cap 2.

The above FIGS. 1–19I illustrate a container, which may be formed of a single molded material, with an inner support system formed within the container for the purpose of displaying sheet material within the container, coupled with means, such as glue or enter locking members, for attaching the container carrying the sheet material onto various items.

Next, FIGS. 20–31 illustrate how the container of the invention can be formed integrally with various items.

Figure 20:
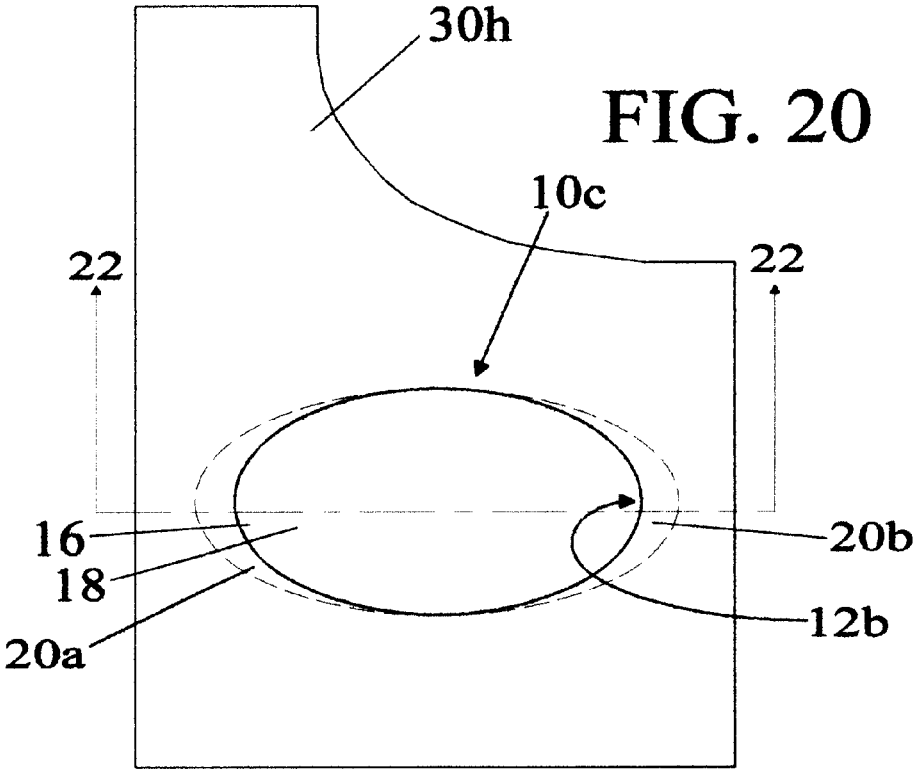
FIGS. 20 and 21 are front views of a mud flap.
Figure 22:
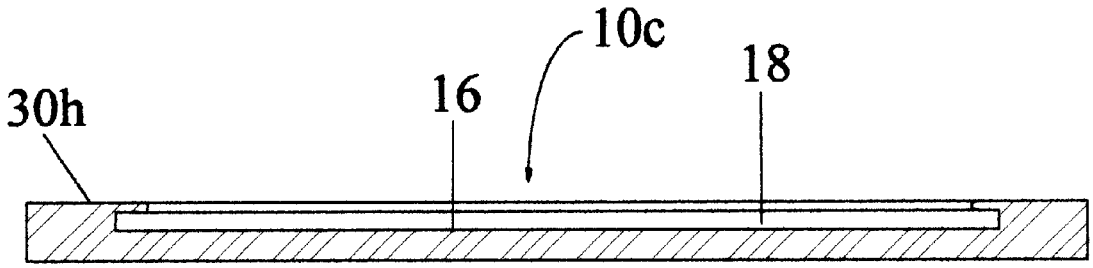
FIG. 22 is a cross sectional view taken on the cutting plane 22—22 of FIG. 20.

FIGS. 20 and 22 show a mud flap 30*h* of the invention molded from a flexible rubber. Container 10*c* is an integral part of the molding and includes the pocket section 16 comprised of an oval-shaped flat base section 18 and lateral, crescent-shaped pockets 20*a,b* with openings 12*a,b* for slidably receiving sheet material 6 to be exhibited within it. Container 10*c* is the same as container 10*a*, except that here the container is molded integrally with the mud flap, rather than being glued or connected to it.

Figure 21:
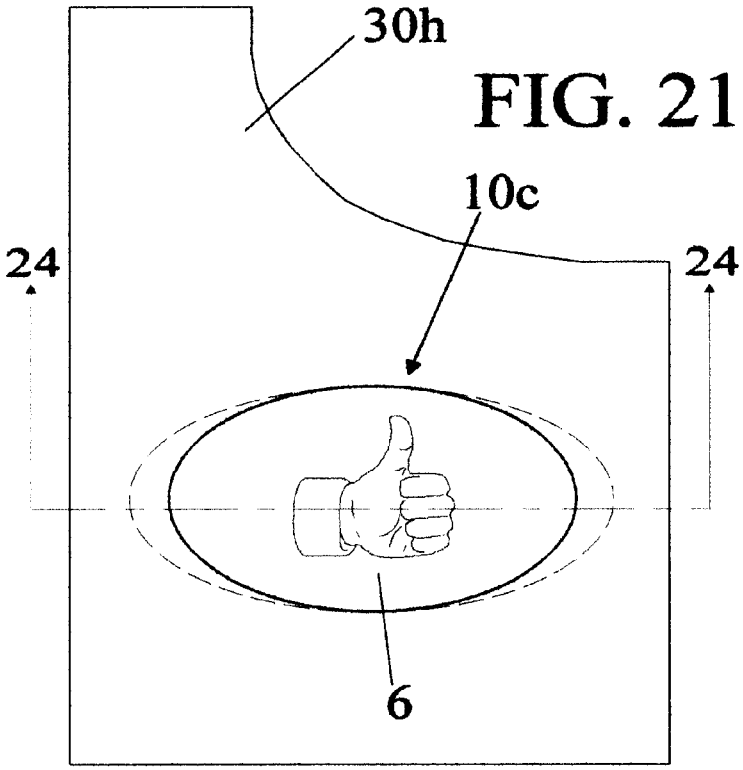

FIG. 21 shows a sheet material 6 inserted in container 10*c*. The sheet material 6, in the shape of an oval, is constructed to be accepted within container 10*c* and to be resiliently detained therein. The sheet material 6 may bear an identification, trademark, advertisement, indicia, mottos, pictures and the like.

Figure 23:
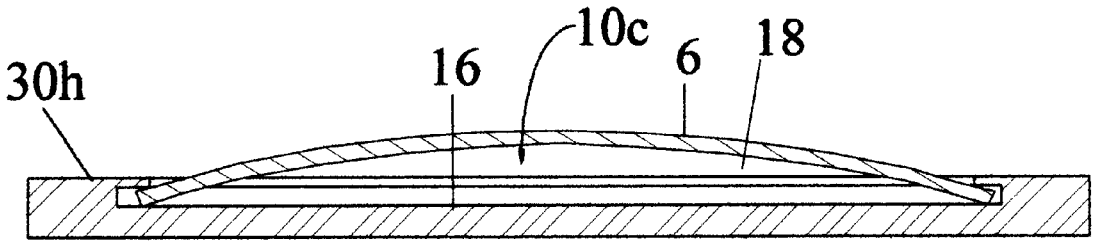
FIG. 23 is a view as in FIG. 22, illustrating a method of the invention.
Figure 24:
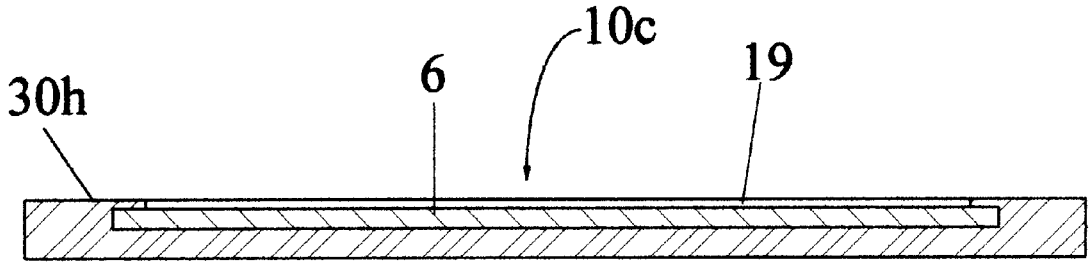
FIG. 24 is a cross sectional view taken on the cutting plane 24—24 of FIG. 21.
Figure 25:
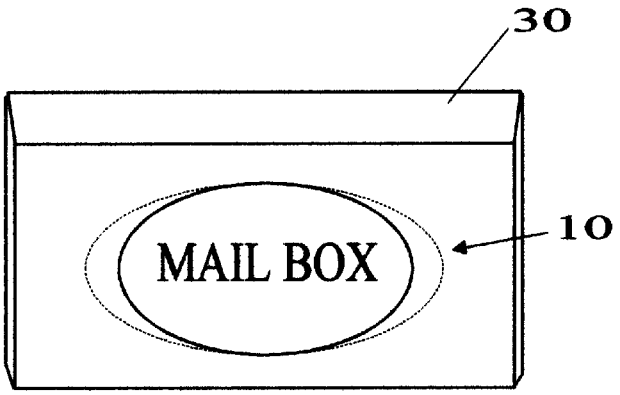
FIGS. 25–32 are front views of items bearing a container 10*c* molded integrally therewith.
Figure 26:
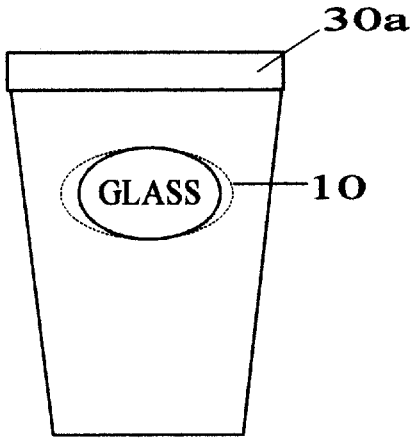
Figure 27:
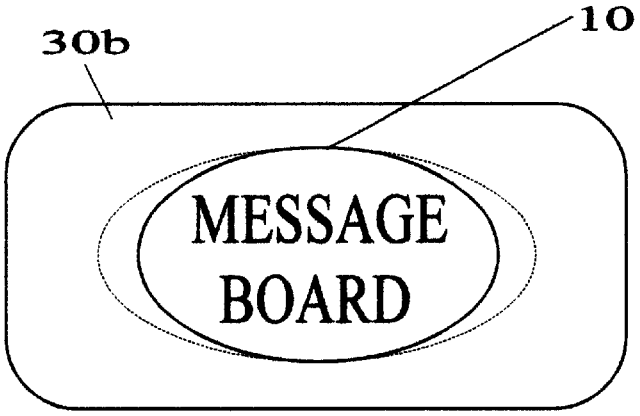
Figure 28:
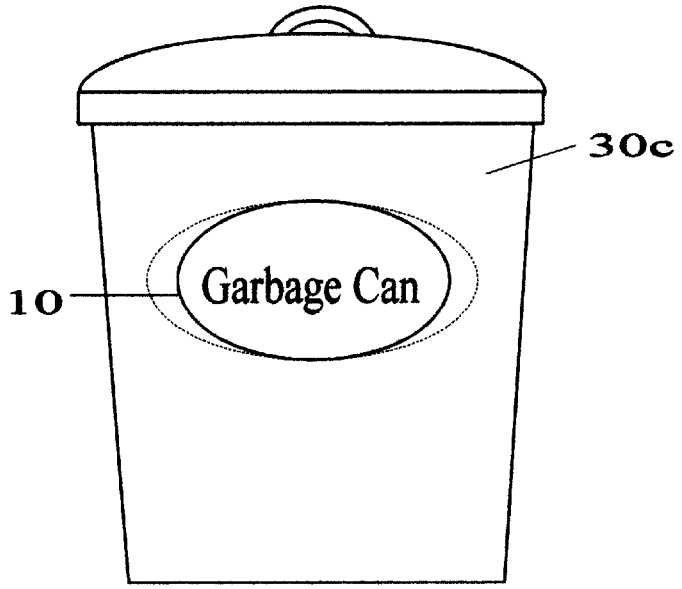
Figure 29:
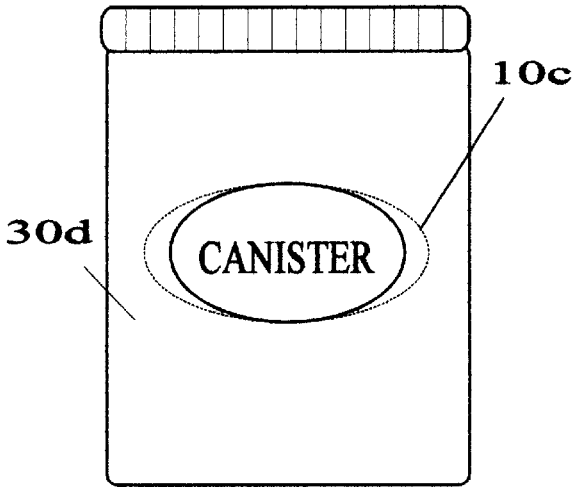
Figure 30:
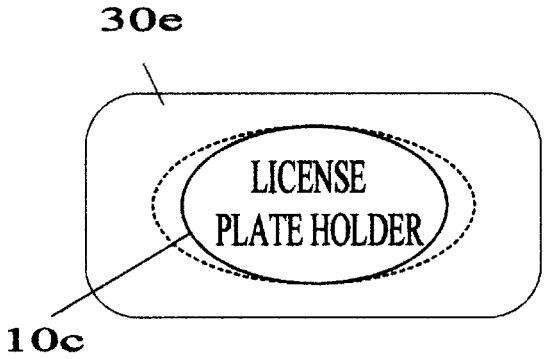
Figure 31:
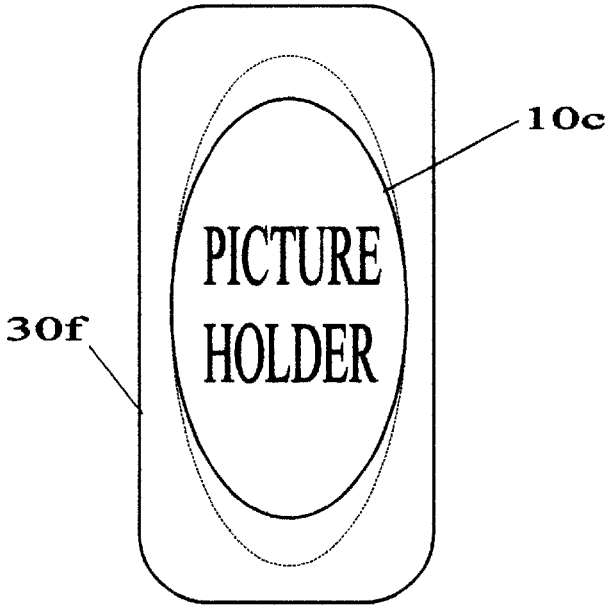
Figure 32:
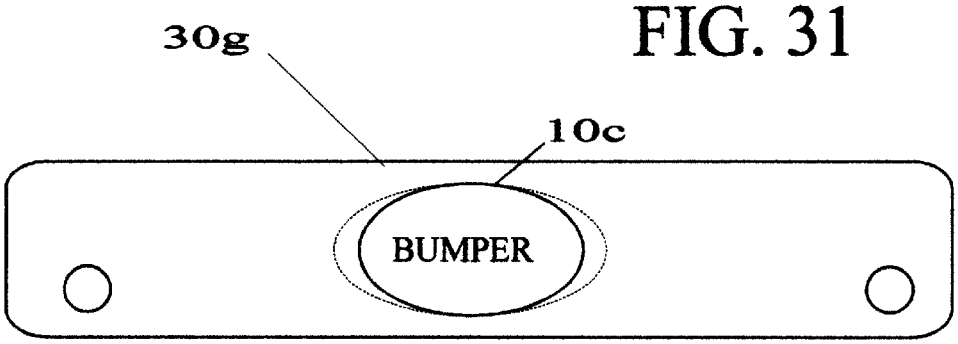

FIGS. 23 and 24 show how to insert and display a sheet material 6 within the container 10*c*, in the same manner described above with respect to FIGS. 7 and 8.

The mud flap 30*h* may be affixed or secured onto a respective receiving section of a vehicle by suitable fasteners.

Although the item used in the invention has been illustrated in the form of a mud flap, it is not to be limited to that item. Thus, FIGS. 25 through 32 are illustrations of the present invention in various other embodiments, all containing an integrally molded container 10*c*, namely, a mail box 30 in FIG. 25, a glass 30*a* in FIG. 26, message board 30*b* in FIG. 27, a garbage can 30*c* in FIG. 28, a canister 30*d* in FIG. 29, a license plate 30*e* in FIG. 30, a picture frame 30*f* in FIG. 31 and a vehicle bumper 30*g* in FIG. 32.

FIGS. 33–38 show an embodiment in which a container 10*d* (FIGS. 37 and 38) is constructed from two different pieces, this being beneficial, for instance, for the molding of the container.

Figure 33:
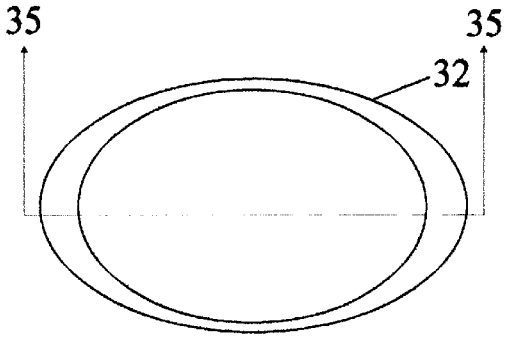
FIGS. 33 and 34 are, respectively, front and back views of a part of a container.
Figure 36:
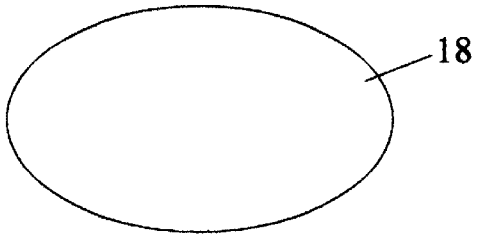
FIG. 36 is a plan view of a second part of the container mentioned with respect to FIGS. 33 and 34.
Figure 34:
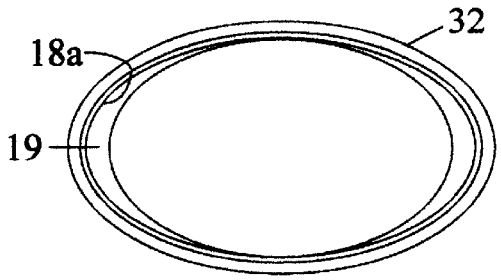
Figure 37:
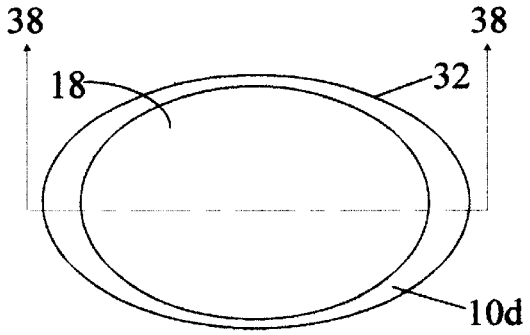
FIG. 37 is a front view of a container from the two parts in FIGS. 33–36.
Figure 35:
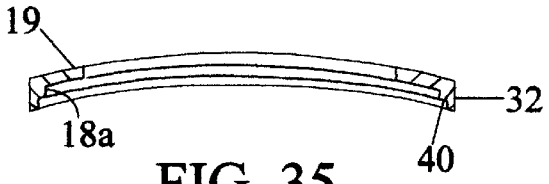
FIG. 35 is a cross sectional view taken on cutting plane 35—35 of FIG. 33.
Figure 38:
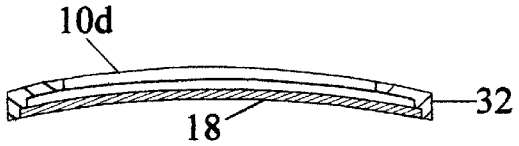
FIG. 38 is a cross sectional view taken on cutting plane 38—38 of FIG. 37.

The first piece 32 is illustrated in FIGS. 33–35 and comprises wall 18*a*, brim 19, and ledge 40. The second piece is simply base section 18. Assembly of the two pieces to form container 10*d* is shown in FIGS. 37 and 38. Base section 18 is received completely within ledge 40. Base section 18 may be glued in place in ledge 40, or, if the materials of construction are thermoplastic, an iron may be pressed against the assembled pieces to cause a small amount of melting, so that, upon cooling, the two pieces become bonded together.

Figure 39:
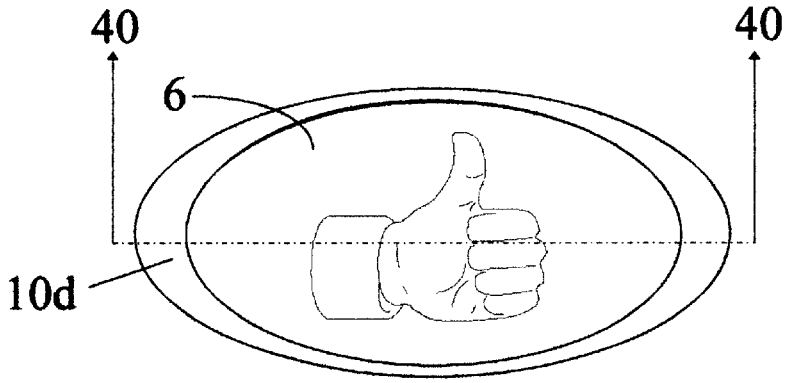
FIGS. 39–42 illustrate method steps associated with placing a sheet material into the container of FIGS. 37 and 38.
Figure 40:
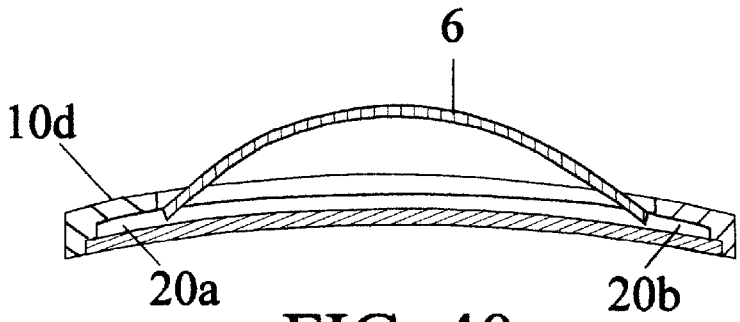
Figure 41:
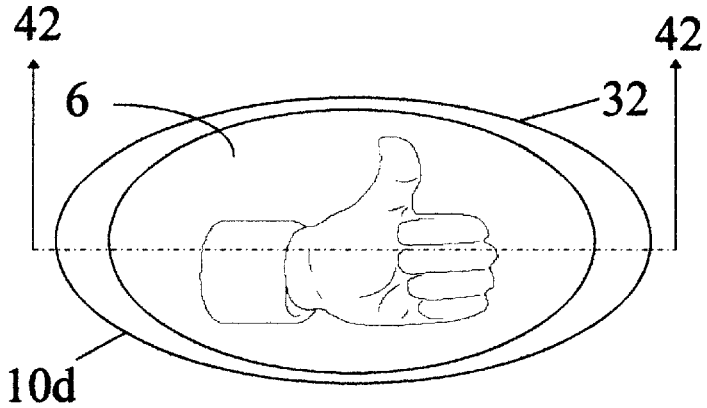
Figure 42:
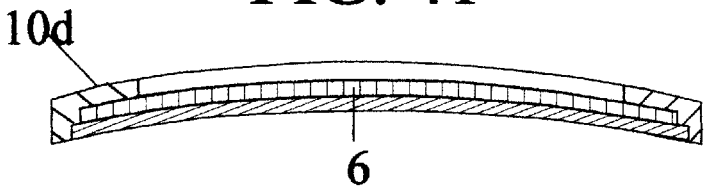

FIGS. 3914 41 show the assembly of a sheet material 6 with container 10*d*. Assembly proceeds in the same manner as described above for FIG. 8, with FIG. 39 and its cross section FIG. 40 presenting the configuration of the sheet material 6 assumed as it is manually bent for insertion into pockets 20*a,b*, and FIG. 41 and its cross section FIG. 42 the final resting position of the sheet material 6 in the container.

FIGS. 43 to 48 show an embodiment of a mud flap of the invention. It differs from that of FIGS. 20 to 24 in two respects. One, a mud flap 30*h* for the passenger side of a vehicle is shown, rather than for the driver's side. And, two, and more importantly, this embodiment provides a vent hole 54 in base section 18 within brim 19 to facilitate extraction of a sheet material from the container, should it be desired to change the sheet material. Vent hole 54 is conceptually like hole 54 in U.S. Pat. No. 5,075,991, incorporated here by reference. However, the hole here does not have to be finger-size, but can, instead, be only big enough to allow, for instance, an eraser on the upper end of the shaft of a pencil to pass through, to dislodge a sheet material from the container.

As indicated above, flat, unbendable embodiments of the invention, such as this mud flap, can make it difficult to extract smooth plastic sheet material, such as laminated pictures of the type disclosed in my U.S. Pat. No. 5,943,698. Vent hole 54 makes this extraction easy.

Because vent hole 54 ordinarily faces vehicle tires in use, it is desirable to provide a water-, and mud-, tight seal for hole 54. This is preferably accomplished according to the invention by a vent valve, as disclosed in U.S. Pat. No. 6,053,474, incorporated here by reference.

Figure 46:
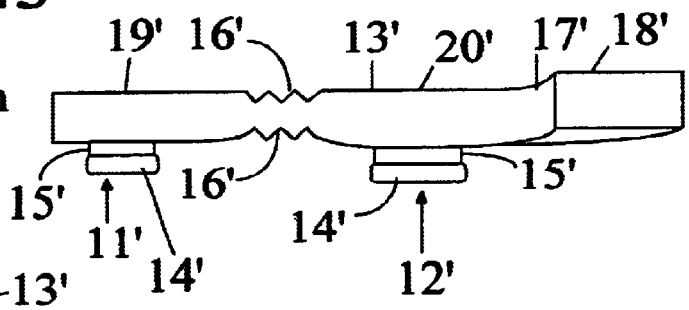
FIG. 46 is a perspective view of a vent valve.

With reference particularly to FIG. 46, details of the vent valve are described as follows. The identical numbers are used here, as are used in U.S. Pat No. 6,053,474, except that here a prime is added, in order not to duplicate numbers already used with respect to previously described FIGS. FIG. 46 is primarily a side elevation view of a vent valve in the present invention. Anchor post 11' and vent post 12' project from the bottom face of body member 13'. The distal portions 14' of posts 11 and 12' are slightly wider than proximal portions 15'.

Figure 43:
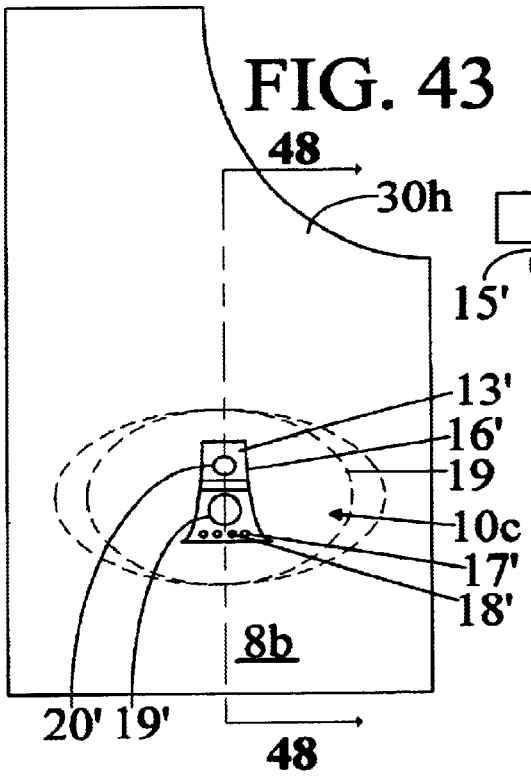
FIGS. 43 to 45 are back views of a mud flap.
Figure 47:
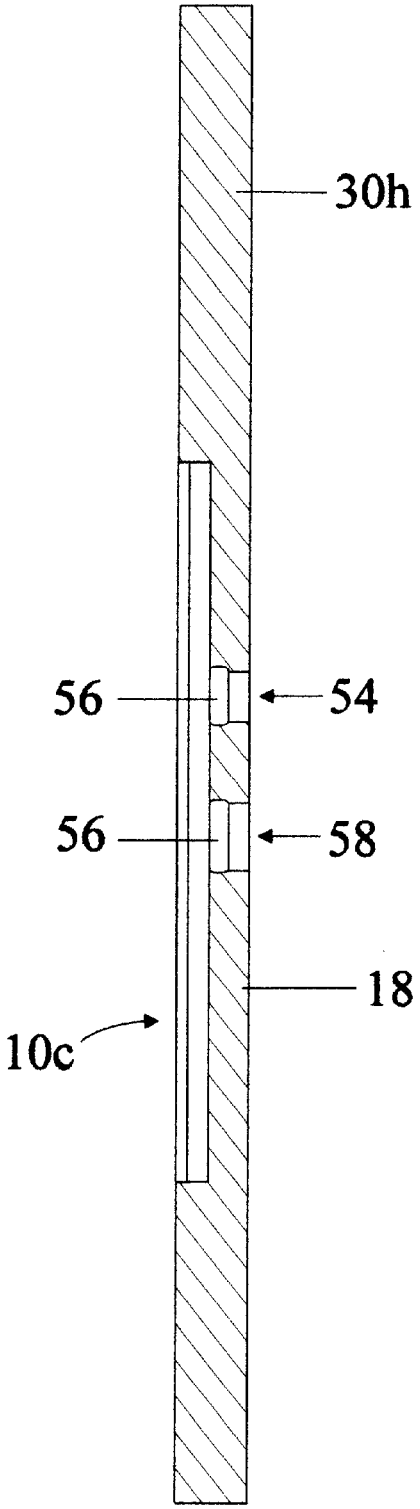
FIGS. 47 and 48 are cross sectional views taken on the cutting planes 47—47 and 48—48 of FIGS. 44 and 43, respectively.
Figure 48:
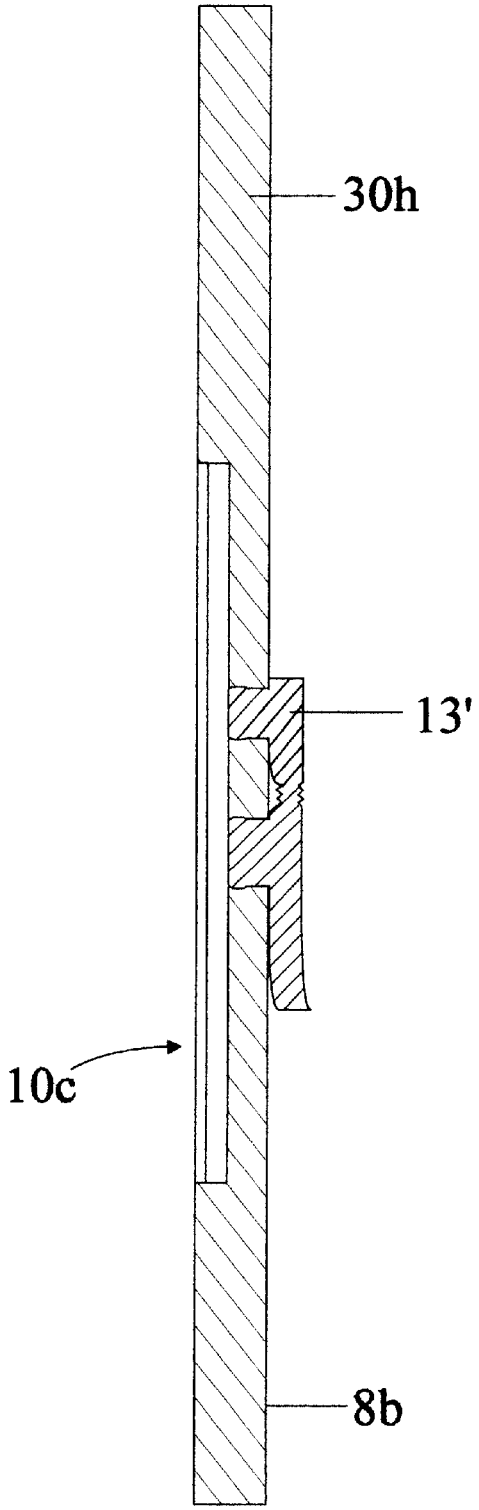

FIGS. 43 and 48 show the vent valve engaged with the mud flap 30*h* and container 10*c*. The bottom face of body member 13' is adjacent to the back side surface 8*b* of the mud flap. As shown in FIG. 47, annular receptacles 56 are recessed in base section 18 to accommodate distal portions 14', so that the distal portions are flush with base section 18, in order not to distend a sheet material in the container. Proximal portions 15' press against the portions of the base section 18 defining the anchor hole 58 and vent hole 54 to form liquid-tight seals. Thin portion 16' on body member 13' facilitates hinging of the valve. The end portion of body member 13' extending beyond vent post 12' can be seen flaring from the surface 8*b*, to form a graspable tab 17' that facilitates disengagement of vent post 12' from the mud flap. The tab points down, so that mud and water drain from the gap between it and surface 8*b*.

Figure 45:
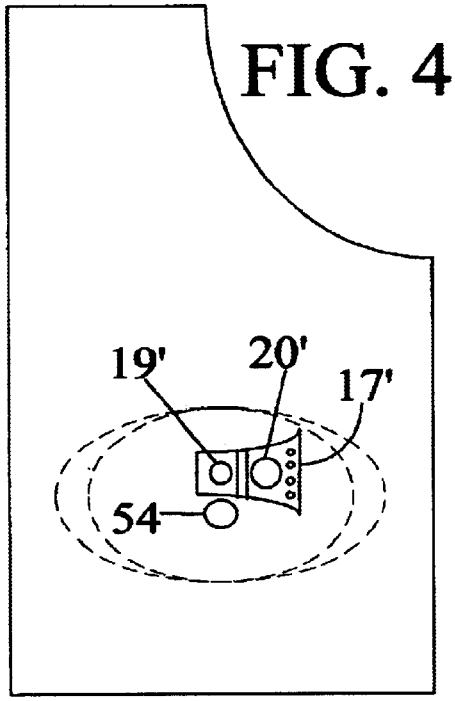
Figure 44:
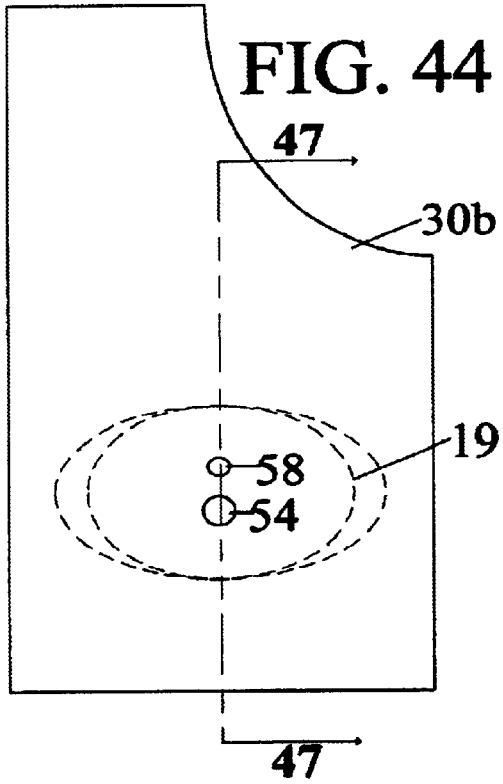

As shown in FIGS. 43 and 45, the top face of body member 13' has score lines indicating the position of thin portion 16'. Tab 17' can be seen fanning laterally to provide a larger structure for grasping. Raised bumps 18' on tab 17' improve a user's grip on tab 17'. Indentations 19' and 20' provide a visual cue to the user of the positions of anchor post 11' and vent post 12', respectively, thereby aiding in alignment of the posts with the corresponding mud flap holes for engagement purposes.

When it is desired to gain access to vent hole 54 to dislodge a sheet material, tab 17' is pulled to free vent post 12' from the hole. The vent valve is then rotated about the anchor post 11 to a position as shown in FIG. 45, away from hole 54. Maintaining the engagement of the anchor post assures that the vent valve will not get lost. To seal the vent hole 54 after the dislodging of a sheet material, the vent valve is rotated back into position and the vent post pushed back into its seat in hole 54.

There follows, now, the claims. It is to be understood that the above are merely preferred modes of carrying-out the invention and that various changes and alterations can be made without departing from the spirit and broader aspects of the invention as defined by the claims set forth below and by the range of equivalency allowed by law.

What is claimed is:

1. A container comprising an oval-shaped base section, an oval brim, and a lateral wall, the wall spacing the base section from the brim, the base section, brim and wall together forming lateral, opposed, crescent-shaped pockets, a perimeter of the base section and an inner edge of the brim having a common minor axis.

2. A container as claimed in claim 1, combined with an item.

3. A container as claimed in claim 2, the container being mounted on the item.

4. A container as claimed in claim 2, the container being formed integrally with the item.

5. A container as claimed in claim 1, the container having a front side and a back side, further comprising enter locking members on the back side.

6. A container as claimed in claim 5, combined with a locking member, the locking member having enter locking portals corresponding to the enter locking members.

7. A container as claimed in claim 6, the enter locking portals having annular recesses on a second side.

8. A container as claimed in claim 1, having a vent hole in the base section within the brim.

9. A container as claimed in claim 8, further having an anchor hole in the base section.

10. A method of using a container as claimed in claim 1, comprising bending a resilient, oval-shaped sheet material about a single axis to allow ends of the sheet material to approach one another, placing the ends on the base section directed toward the pockets, and permitting the sheet material to straighten, whereupon the sheet material slidably enters into the pockets and comes to rest in the pockets, where it is constrained as to orientation by the wall.

11. A method as claimed in claim 10, the sheet material bearing an image.

12. A container comprising an oval-shaped base section, an oval brim, and a lateral wall, the wall spacing the base section from the brim, the base section, brim and wall together forming lateral, opposed, crescent-shaped pockets, the brim and wall being formed as one piece and the base section being formed as another piece, the one piece having a ledge for receiving the other piece completely within the ledge.

13. A container comprising an oval-shaped base section, an oval brim, and a lateral wall, the wall spacing the base section from the brim, the base section, brim and wall together forming lateral, opposed, crescent-shaped pockets, having a vent hole in the base section within the brim, further having an anchor hole in the base section, combined with a vent valve having vent and anchor posts sealing the vent and anchor holes.

14. A container as claimed in claim 13, the vent and anchor holes having annular receptacles in the base section for accommodating distal portions of the vent and anchor posts.

15. A container as claimed in claim 14, the vent valve rotating about the anchor post, when the vent post is disengaged from the vent hole.

16. A method of using a container comprising an oval-shaped base section, an oval brim, and a lateral wall, the wall spacing the base section from the brim, the base section, brim and wall together forming lateral, opposed, crescent-shaped pockets, said method comprising bending a resilient, oval-shaped sheet material about a single axis to allow ends of the sheet material to approach one another, placing the ends on the base section directed toward the pockets, and permitting the sheet material to straighten, whereupon the sheet material slidably enters into the pockets and comes to rest in the pockets.

17. A method as claimed in claim 16, the sheet material bearing an image.

* * * * *